United States Patent [19]

Ackerman

[11] Patent Number: 4,469,386

[45] Date of Patent: Sep. 4, 1984

[54] TAMPER-RESISTANT TERMINATOR FOR A FEMALE COAXIAL PLUG

[75] Inventor: Abram Ackerman, New Hyde Park, N.Y.

[73] Assignee: Viewsonics, Inc., Syosset, N.Y.

[21] Appl. No.: 304,847

[22] Filed: Sep. 23, 1981

[51] Int. Cl.[3] ..... H01R 13/44

[52] U.S. Cl. ..... 339/37; 339/38; 339/82; 339/85

[58] Field of Search ..... 339/36, 37, 38, 80–85

[56] References Cited

U.S. PATENT DOCUMENTS

| | | | |
|---|---|---|---|
| 3,519,979 | 7/1970 | Bodenstein | 339/85 |
| 3,573,702 | 4/1971 | O'Keefe | 339/37 |
| 3,845,454 | 10/1974 | Hayward et al. | 339/85 |
| 3,890,028 | 6/1975 | Blanchenot | 339/85 |
| 3,953,097 | 4/1976 | Graham | 339/37 |
| 4,053,195 | 10/1977 | Laverick et al. | 339/82 |

*Primary Examiner*—John McQuade
*Assistant Examiner*—Paula Austin
*Attorney, Agent, or Firm*—Darby & Darby

[57] ABSTRACT

A coupling device includes a housing, a coupling cap within the housing, first means for rotatably engaging the cap with the housing, second means for engaging the cap with the coupling, third means for engaging a workpiece to the cap, and fourth means for providing tool access from the housing to the third means.

7 Claims, 7 Drawing Figures

TAMPER-RESISTANT TERMINATOR FOR A FEMALE COAXIAL PLUG

BACKGROUND OF THE INVENTION

This invention relates to closures for threaded couplings and more particularly to a terminator and lock for a female coaxial plug, such as is used in cable television systems (CATV), multipoint distribution systems, subscription television (STV) and master antenna TV systems (MATV).

It is a conventional practice in cable television systems to permit a plurality of individual subscribers to be connected to a single signal-carrying coaxial cable. Conventionally, this is accomplished by connecting the cable to a transformer or other impedance-matching-/amplifying device which has a plurality of output ports. Each output port is usually a female coaxial plug. A cable can then be routed from each of these female coaxial plugs to a receiver unit of a subscriber to the signal-carrying system.

In such systems it is possible that the number of subscribers will at times be less than the number of female coaxial plugs which are provided on, e.g., a signal splitter, coupler, wall-plate termination and multi-taps. Under such circumstances it is then desirable to terminate each plug with an impedance that will match the impedance of the coaxial cable. This prevents an impedance mismatch between the signal-carrying cable and any subscriber cables that are connected, and can be accomplished by using a conventional male coaxial plug in which an impedance device such as a resistor is connected across the male coaxial plug.

A problem has arisen with regard to such terminated plugs. It has been found that non-subscribers to, e.g., a cable television network have attempted to steal the services of the network by removing the male coaxial terminator plugs, and connecting their own illegal coaxial cables to the female coaxial plugs, and failing to tender payment to the network.

It is known to provide tamper-resistant devices for terminating female coaxial plugs. Such a device is threaded onto the female coaxial plug and can be removed by using a special tool which is posessed by certain employees of the subscriber system.

Another problem encountered by, e.g., cable television networks is the problem of subscriber disconnection. If a coaxial cable has been once connected to a subscriber's location, and service is later terminated, it is possible to disconnect the subscriber's cable and to terminate the female coaxial plug to which the cable was previously connected. This leaves an obviously disconnected cable hanging unattached. A disconnected subscriber may then without the permission of the signal carrier proceed to remove the terminating device and reattach the coaxial cable to the female coaxial plug.

In prior-art plug terminating devices, the tool used to remove the tamper-resistant device has delicate moving parts such as springs, ball-bearings, etc. Such tools have a tendency to fail in use. Moreover, the prior art coupling devices use machined parts which are relatively expensive to manufacture. Furthermore, the assembly of the parts of such tools can also be relatively expensive.

An object of the invention is to provide a rugged tamper-resistant closure device for terminating a female coaxial plug.

Another object is to provide such a device which is operable by a tool having no moving parts.

It is another object of the invention to provide a device of this type which would be resistant to tampering by intruders in possession of commonly-available implements and items, such as screwdrivers, wrenches and the like.

SUMMARY OF THE INVENTION

These objects are achieved in the invention by providing an inner cap for a plug and an outer housing for the cap wherein the cap is rotatably secured within the outer housing. The housing is free to rotate about the cap but is limited in its translational movement with respect to the cap, so that the housing and cap cannot be separated from each other. The cap itself includes plug engaging means, such as an internally threaded well which can be threaded onto an exposed end of a female coaxial plug, thereby preventing a cable from being attached hereto. The housing itself is coaxial with the cap and supported in place by the engagement of the threaded cap to the plug. The cap has a tool engagement region which is opposed to the well and is offset from a centerline of the well.

The tool engagement region of the cap is not visible to the observer and can be coded, such as by provided unique indents thereon which are only compatible with properly coded keys. The keys are provided with complementary prongs to engage the indents.

If a wrench or other common tool is used to rotate the housing, the housing will merely rotate about the cap and the cap will remain threaded on the female coaxial plug. Only when a compatible tool is introduced into the housing will it be possible to engage the cap rather than the housing and to thereby remove the cap from the female coaxial plug.

BRIEF DESCRIPTION OF THE DRAWINGS

Presently preferred but nonetheless illustrative embodiments of the invention are shown in the drawings, in which.

DETAILED DESCRIPTION OF PREFERRED EMBODIMENTS

Figure 1:
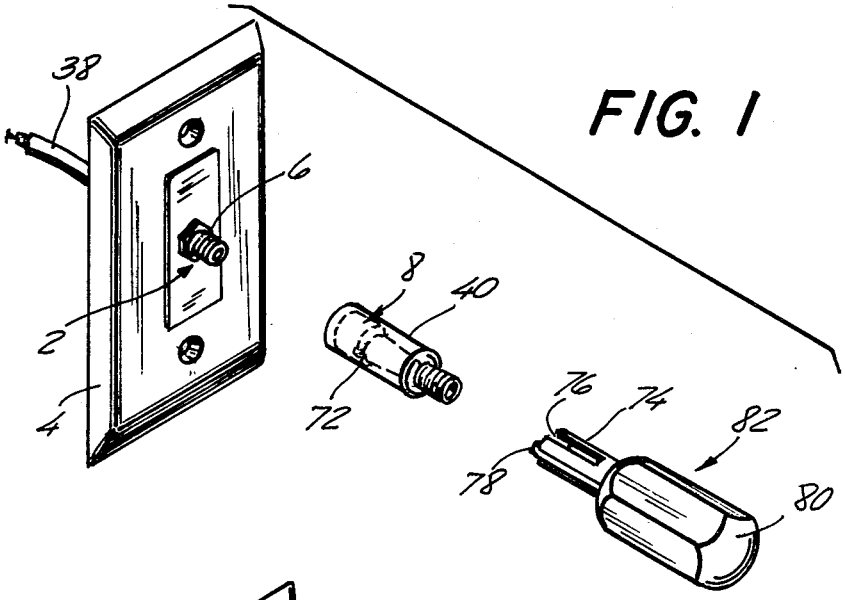
FIG. 1 is an exploded view showing a terminator and operating tool in relation to a wall mounted coaxial plug.

In the following description of a preferred embodiment of this invention, each element is identified by the same reference numeral in all of the drawings.

Referring now to FIG. 1, there is illustrated a double-ended female coaxial plug 2 for use with, e.g., 75 ohm coaxial cable which is mounted to a wall bracket 4. The plug 2 is connected to a coaxial cable 38 and has an exposed end 6 on which a compatible male coaxial plug must be threaded in order to establish a connection with coaxial cable 38.

As further shown in FIG. 1, cap 8 is disposed in axial alignment within housing 40.

As further shown in FIG. 1, housing 40 can be axially aligned with plug 2; tool 82 also can be axially aligned with housing 40. The preferred embodiment of cap 8, housing 40 and tool 84 are described below with reference to FIGS. 4,5,6 and 7.

Figure 2:
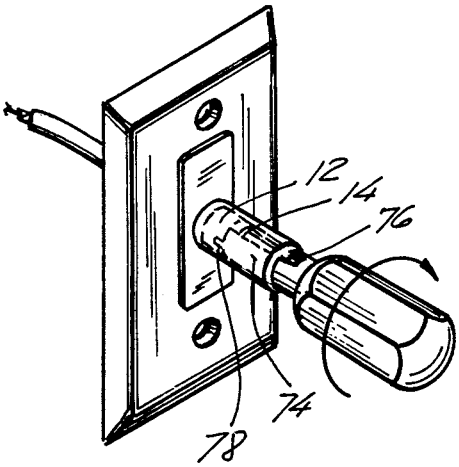
FIG. 2 illustrates the use of a tool with respect to installation of the tamper-resistant coaxial terminator of the present invention.
Figure 3:
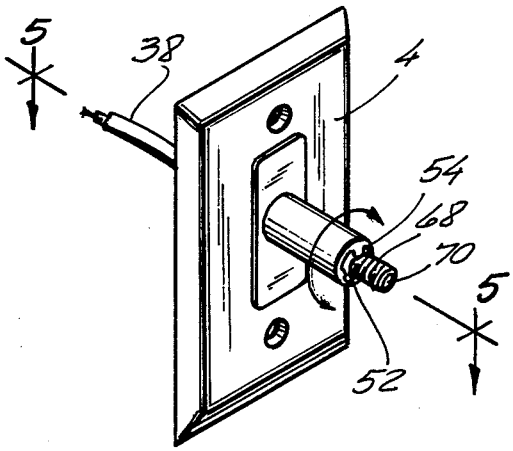
FIG. 3 is a perspective view of the present invention as installed on a coaxial plug.

In order to secure plug 2, a person would insert tool 82 into housing 40 until the tool engages the compatible tool engagement region of the cap, as best shown in FIGS. 1 and 2. Thereafter, tool 82 is rotated until cap 8 is securely threaded in place on plug 2.

Figure 7:
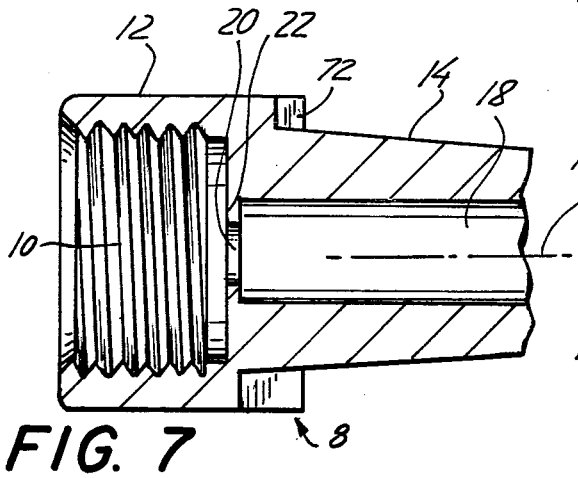
FIG. 7 is a sectional view of the cap of a second embodiment of the tamper-resistant device disclosed herein.
Figure 6:
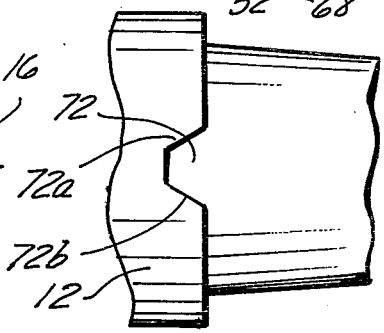
FIG. 6 is an elevation of a portion of the cap of the tamper-resistant device as disclosed herein.

Referring now to FIGS. 6 and 7, cap 8 has an internally threaded well 10 which is adapted to mate with the exterior threads on plug 2. Cap 8 has a generally cylindrical enlarged region 12 in which well 10 is located. Cap 8 further has a generally frusto-conical region 14 which is opposed to well 10. In this example, cap 8 is die cast and made of zinc, although any other suitable method of manufacture or electrically conductive material may be used.

As shown in FIG. 7, Cap 8 is axially symmetrical about centerline 16 and has an axially centered bore 18. Bore 18 communicates with well 10 via a port 20 located in the center of an annular flange 22. Flange 22 is located at that end of bore 18 which is adjacent well 10. It is provided to help locate and relatively fix an impedance device within bore 18.

Figure 4:
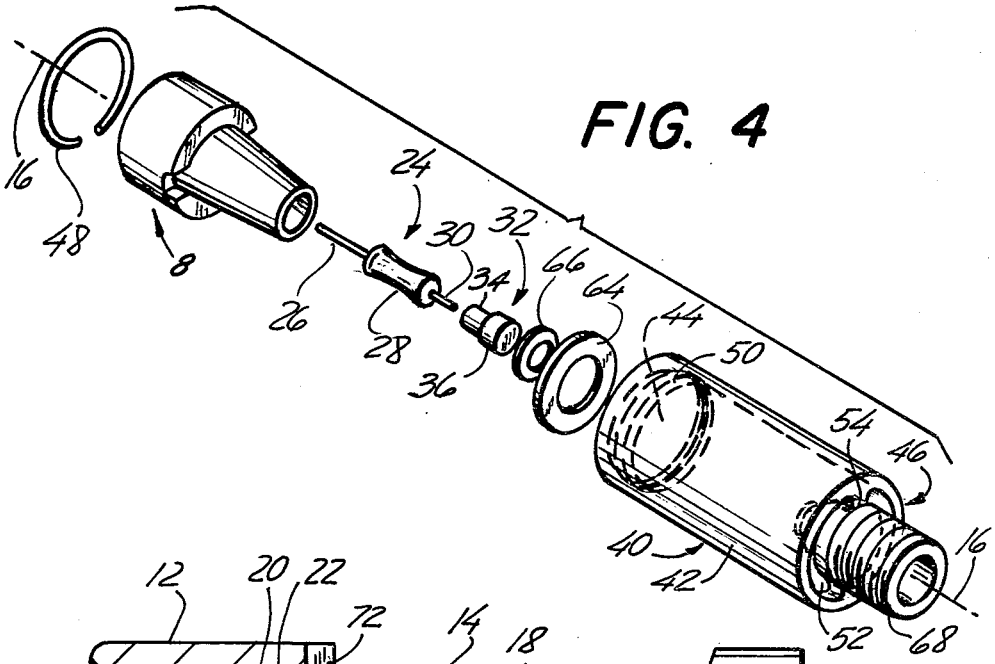
FIG. 4 shows an exploded view of the tamper-resistant device disclosed herein.
Figure 5:
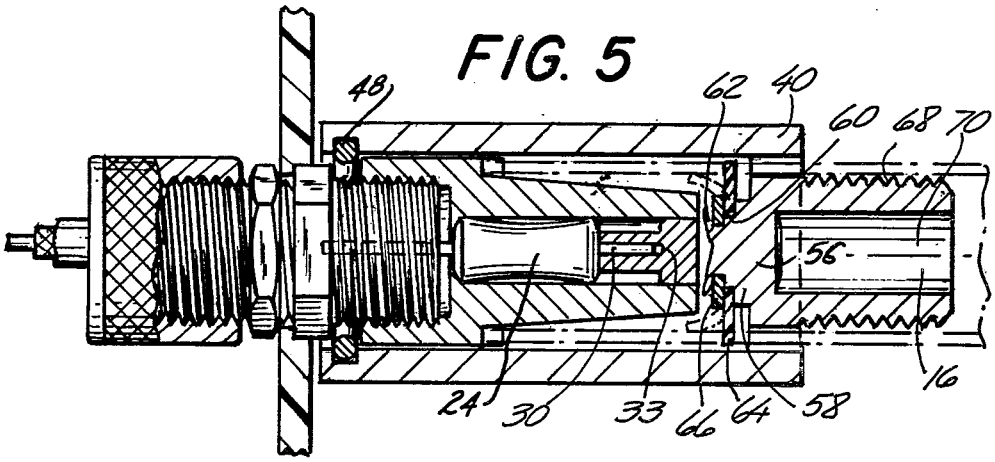
FIG. 5 is a cross-sectional elevation of the tamper-resistant device disclosed herein installed on a female coaxial plug, the elevation being taken along line 5—5 of FIG. 3.

Referring to FIGS. 4 and 5, it is seen that an impedance device, such as a ½ watt, 75 ohm resistor generally indicated by reference 24 is received within cap 8. Resistor 24 has a lead 26, a body 28, and another lead 30. Leads 26 and 30 are elongated along centerline 16 and lead 26 is longer than lead 30.

In order to provide a snug fit of body 28, bore 18 is sized such that resistor 24 can be introduced and received within it without any substantial amount of axial play between body 28 and cap 8. When resistor 24 is replaced within bore 18, lead 26 passes through port 20 and resistor body 28 of resistor 24 is prevented from axially entering well 10 by flange 22. Hence, lead 26 extends axially along centerline 16 of cap 8 when the device is assembled. Lead 26 serves as an electrical conductor which is introduced into female coaxial plug 2.

Resistor lead 30 is received within a unitary, relatively cylindrical receptacle generally indicated by reference numeral 32. Receptacle 32 is manufactured of an electrically conductive material, such as brass, and has a relatively narrow cylindrical section 34 open at one end and a wide cylindrical section 36 closing the other end. As shown in FIG. 5, receptacle 32 has an axial bore 33 in axial communication with centerline 16, into which lead 30 is introduced. This bore is slightly undersized so that a tight electrical connection exists between resistor 24 and receptacle 32 via lead 30.

Receptacle 32 is received within bore 18 and tightly mated with cap 8, as by press-fitting. This causes receptacle 32 to be fixed with respect to cap 8. The respective ends of resistor body 28 abut against flange 22 and the outer face of cylindrical section 34. As a result, resistor 24 is held within receptacle 32 and cap 8 and is prevented from axially moving, and good electrical connection between cap 8 and resistor 24 is established. While receptacle 32 is pressed-fitted into cap 8 in this example, any other suitable method connection may be employed.

When cap 8 is threaded onto the exposed end 6 of the female coaxial plug, cable 38 will be terminated by resistor 24. In this example, resistor 24 is chosen to be a 75 ohm resistor because coaxial cables used for cable television frequently have 75 ohm impedances. However, if cable 38 has an impedance other than 75 ohms, another resistor 24 with an appropriate resistance can be selected. Alternatively, if cable 38 is to be shorted rather than terminated with an appropriate impedance, resistor 24 can be eliminated and an elongated conductor substituted therefore, the conductor having one end located at the open end of well 10 and another end either attached to the receptacle 32 or otherwise connected to cap 8. Furthermore, if cable 38 is to be terminated with a reactive network, a coil, capacitor, or network can be held within and connected to cap 8, as long as the network has a conductor such as lead 26 extending into well 10 with one end at the open face of the well and the other end at or near the bottom of well 10.

Referring now to FIGS. 4 and 5, a cylindrical housing, for cap 8 generally indicated by reference numeral 40, has a cylindrical barrel 42 with an open end 44 and a partially closed end 46. Cap 8 is received within open end 44 of housing 40. Cap 8 is prevented from falling out of open end 44 of barrel 42 by a C-shaped snap ring 48 which is fitted into an annular groove 50 in the interior of barrel 42 and closely adjacent open end 44. Housing 40 is here die cast of zinc, but other materials and methods of manufacture can be used.

Cap 8 is free to rotate within housing 40, however, its translational axial movement therewithin is limited by snap ring 48 and by peened or swaged section 62 of housing 40. If cap 8 is threaded onto the exposed end 6 of female coaxial plug 2 as described below, rotation of housing 40 by a wrench or other tool will merely cause housing 40 to rotate about cap 8 without rotating cap 8 itself.

In a first embodiment of the device, as shown in FIGS. 5 and 6, a selected code for access to engagement with cap 8 is provided, as by two axially offset, diametrically opposed notches 72 cut into enlarged region 12 of cap 8. These notches extend toward the tool receiving end of cylinder 40. In this first embodiment, of the invention, notches 72 are identical and thus have equal depths. Furthermore, notches 72 have diverging side walls *72a, 72b*.

Notches 72 serve as tool engagement regions where a tool such as that described below, can engage cap 8 and rotate it to thread it on or off female coaxial plug 2. It is conceivable that only one notch 72 will be adequate to provide enough leverageon cap 8 to tighten or loosen it but in this preferred embodiment two notches 72 assure sufficient engagement is obtained. There may be more than two notches 72, and the notches may be distributed evenly around the circumference of cap 8 or may alternatively be irregularly spaced. Furthermore, as is shown in more detail in FIG. 7, the notches may be of different depths to effect a different code. Alternate constructions can be used in which the tool engagement regions of cap 8 are, e.g., projections instead of notches and the complementary portions of a tool are notches. While notches have proved advantageous in these preferred embodiments, differently shaped tool engagement regions are within the scope of the invention.

In order to decrease unauthorized access to cap 8, housing 40 is provided at its outer cylindrical face with a partially closed end 46, as shown in FIG. 4. Further, to prevent access by tools other than the specially designed compatible tool of the invention, end 46 can be provided with, e.g., two arcuate slots 52 which face each other.

To prevent observation through slots 52, in this preferred embodiment, a gasket 64, as shown in FIG. 5, is mounted near end 46. An axially projecting, threaded plug 68 is provided to offer means for engaging housing 40. This is in effect a decoy device which when engaged only leads to rotation of housing 40, but not cap 8. Radially inwardly extending integral ribs 54 define the adjacent ends of slots 52 and axially position block structure 56, which is integral with barrel 42. Block 56 is adapted to support gasket 64 and has three cylindrical sections which are axially centered on each other. As seen in FIG. 5, the first section 58 has the widest diameter, the second section 60 has a narrower diameter and approximately the same axial length as section 58, while section 62 has the smallest diameter and, originally, the greatest axial length.

An annular elastomeric gasket 64 of, e.g., rubber is mounted to block 56 and just fits around section 60 thereof. Section 60 is selected to have an axial length equal to the thickness of gasket 64. After gasket 64 has been mounted an annular retaining ring 66 is mounted to block 46 and surrounds section 62. After retaining ring 66 has been installed, section 62 is deformed, as by peening or by swaging, so that retaining ring 66 is prevented from moving. In FIG. 5, section 62 is shown in its, e.g., peened or swaged state.

Gasket 64 is thus held in position on block 56 between section 58 and retaining ring 66. While the radially outermost section of gasket 64 can be deformed, the radially innermost section of gasket 64 remains fixed. The radius of gasket 64 is selected to block visibility into housing 40.

As mentioned above, in order to deceive the potential unauthorized user of the cable system, cylinder 40 is elongated outside partially closed end 46 and is externally threaded at cylindrical region 68. Cylindrical region 68 has an axially centered well 70 which extends through region 68 and into region 56. This structure forms a false female coaxial plug.

Because slots 52 are arcuate, it is difficult to introduce conventionally available implements such as screwdrivers into slots 52. Furthermore, because at least the major portion of slots 52 are blocked by gasket 64, it is impossible for a potential intruder to peer into the device. Gasket 64 thus is a baffle which prevents visual inspection of the interior of housing 40 while deforming to admit fingers on a tool described below.

A tool of the invention is depicted in FIGS. 1 and 2. This tool 82 has two arcuate fingers 74, which face each other, and a handle 80. Each finger can pass axially through one of slots 52. Groove 76, lie between the opposed edges of fingers 74 and are sized to pass around ribs 54. Each finger 74 has a prong 78 at its distal end which engages a corresponding one of the notches 72. In the example shown, fingers 74 and prongs 78 are made from a unitary piece of, e.g., machined tempered steel.

It has been found that by using die-cast components for cap 8 and housing 40 and machined tempered steel for fingers 74 and prong 78 that unexpectedly high amounts of torque can be appied by tool 82 to cap 8, thus resulting in a more secure engagement of cap 8 with plug 6. Since cap 8 can be very securely engaged to plug 6, it is very difficult to remove the cap without a proper tool. Another advantage of using die casting to fabricate cap 8 is that notches 72 can be shaped to form receptacles which are difficult to engage by all but complementary prongs 78.

The presently preferred embodiment of the securing device of the invention includes cap 8, retained within cylinder 40. Resistor 24 is within cap 8 and gasket 64 within cylinder 40. Referring to FIGS. 2 and 5 together, when plug 2 is to be secured and cable 38 terminated, to prevent tampering by an intruder, tool 82 is inserted through end 46 so that each of the fingers 74 passes through a corresponding one of the slots 52. Handle 80 can then be rotated, rotating housing 40, to align prongs 76 with, and engage, notches 72.

Upon such engagement, handle 80 may be rotated, rotating cap 8. Cap 8 can then be threaded onto or removed from coaxial plug 2. After installation, removal of tool 82 will leave housing 40 free to rotate about cap 8, which will remain threaded to plug 2.

To remove cap 8, tool 82 can be inserted into housing 40 to engage cap 8. Upon such engagement, handle 80 can be rotated counterclockwise and the device removed from female coaxial plug 2.

It will be appreciated that changes in the number or shape of notches 72 will necessitate corresponding changes in the shape and location of the prongs on tool 82. Thus, if there are three notches 72, the tool would have three prongs 78. As shown in FIG. 7, the notches can be of different sizes.

Should a foreign object be introduced into the device through one of slots 52, and should the foreign object reach one of notches 72, it will be very difficult to rotate cap 8. Moreover, 64 is preferably made from a deformable material and will make it difficult to see into the device, since gasket 64 will only deform locally where the foreign object is introduced.

The increasing width between side walls **72*a*, 72*b* of notches 72 will tend to cause an inserted foreign object to slide out of notch 72 when the object is rotated and thereby prevent cap 8 from also being rotated. Furthermore, the constricted dimensions between frusto-conical region 14 and housing barrel 42 are such that it is unlikely that a foreign object will actually reach one of the notches 72. Finally, in the event that a long thin tool is introduced into the device and does reach the bottom of one of the notches 72, it will still be difficult to rotate cap 8 because application of force to the foreign object will tend to cause it to move to one of the ends of one of the slots 52 and to thereby become jammed between barrel 42 and conical region 14**. In these ways, the device is made tamper-resistant.

It will be understood that various modifications and adaptations of the foregoing device might be made by persons skilled in the art without departing from the scope of the invention. The invention therefore is not to be limited except as defined in the appended claims.

What is claimed is:

1. A coupling device for selectively preventing and enabling access to a coaxial plug comprising:

a housing, a coupling cap within said housing, means for retaining said cap within said housing, said cap and housing being rotatable with respect to each other about a common axis when said cap is so retained within said housing, means for engaging said cap with said plug, said cap being formed with spaced-apart tool-engagement means, and said housing being formed with spaced-apart slot means that can be aligned with said tool-engagement means in such a manner that spaced-apart fingers which are formed on a rigid tool and respectively capable of passing through said slot means are respectively engageable with said tool-engagement means for selectively engaging said cap with and disengaging said cap from said plug, and further comprising a deformable baffle between said slot means and said tool-engagement means.

2. A device as described in claim 1 wherein said cap comprises a head and a body extending therefrom, said head being formed with a well, said body being formed with a central bore that communicates with said well, and said means for engaging said cap with said plug comprising thread means formed in said well.

3. A device as described in claim 1 wherein said retaining means comprises a circumferential channel formed near one end of the inner surface of said housing, and a relatively circular spring clip engaged in the channel.

4. A device as described in claim 1 wherein the plug terminates a TV cable, further comprising a matching impedance resistor mounted within said cap for electrical connection to said cable.

5. A device as described in claim 1 wherein the axial length of the cap is less than the distance between said retaining means and the baffle.

6. A device as described in claim 1 wherein said cap is coaxial with said housing and comprises a cylindrical head and a body extending from the head, at least a portion of said head adjacent to said body being radially wider than said body.

7. A device as described in claim 6 wherein said tool-engagement means comprises at least two notches formed in said head.

* * * * *